US012371958B2

(12) United States Patent
Telfer et al.

(10) Patent No.: US 12,371,958 B2
(45) Date of Patent: Jul. 29, 2025

(54) ON DEMAND LOW SHOCK BALL SEAT SYSTEM AND METHOD

(71) Applicant: Schlumberger Technology Corporation, Sugar Land, TX (US)

(72) Inventors: George Telfer, Aberdeen (GB); Stephen Lewis, Aberdeen (GB); Alasdair Tait, Aberdeen (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/560,792

(22) PCT Filed: May 17, 2022

(86) PCT No.: PCT/US2022/029598
§ 371 (c)(1),
(2) Date: Nov. 14, 2023

(87) PCT Pub. No.: WO2022/256170
PCT Pub. Date: Dec. 8, 2022

(65) Prior Publication Data

US 2024/0247566 A1 Jul. 25, 2024

Related U.S. Application Data

(60) Provisional application No. 63/196,246, filed on Jun. 3, 2021.

(51) Int. Cl.
*E21B 23/04* (2006.01)
*E21B 33/12* (2006.01)

(52) U.S. Cl.
CPC ..... *E21B 23/0413* (2020.05); *E21B 33/12* (2013.01); *E21B 2200/04* (2020.05)

(58) Field of Classification Search
CPC . E21B 34/142; E21B 23/0413; E21B 2200/04
See application file for complete search history.

(56) References Cited

U.S. PATENT DOCUMENTS 4,917,191 A * 4/1990 Hopmann ..... E21B 34/14 166/381
5,960,881 A * 10/1999 Allamon ..... E21B 34/14 166/70

(Continued)

FOREIGN PATENT DOCUMENTS

CA 2196857 C * 5/2007 ..... E21B 21/00
EP 2620586 A2 7/2013

(Continued)

OTHER PUBLICATIONS

International Search Report and Written Opinion issued in PCT Application PCT/US2022/029598, dated Aug. 30, 2022 (11 pages).

*Primary Examiner* — Jennifer H Gay
(74) *Attorney, Agent, or Firm* — Jeffrey D. Frantz

(57) ABSTRACT

A technique facilitates temporary plugging of a well string via a ball seat assembly which may be actuated on demand. The ball seat assembly includes a ball seat mechanism which works in cooperation with an on-demand assembly actuated via a pattern of pressure changes applied within the ball seat assembly. The on-demand assembly is constructed such that the pattern of pressure changes enables shifting of the ball seat mechanism to a ball release position. However, the ball seat mechanism is not able to function until the desired pattern of pressure changes is completed. Additionally, the on-demand assembly may be structured such that the ball seat mechanism is transitioned to the ball release position at a low pressure point of the pattern of pressure changes to avoid pressure surges within the well string.

17 Claims, 3 Drawing Sheets

(56) References Cited

U.S. PATENT DOCUMENTS

| | | | | |
|---|---|---|---|---|
| 6,079,496 | A | 6/2000 | Hirth | |
| 6,634,428 | B2 | 10/2003 | Krauss | |
| 6,866,100 | B2 * | 3/2005 | Gudmestad | E21B 34/102 166/166 |
| 7,416,029 | B2 * | 8/2008 | Telfer | E21B 23/006 166/318 |
| 7,921,922 | B2 * | 4/2011 | Darnell | E21B 33/12 166/383 |
| 8,356,670 | B2 * | 1/2013 | Telfer | E21B 23/04 166/194 |
| 8,418,769 | B2 * | 4/2013 | Fay | E21B 23/04 166/194 |
| 8,636,073 | B2 * | 1/2014 | McNeilly | E21B 34/14 166/334.4 |
| 9,045,966 | B2 * | 6/2015 | Ali | E21B 34/142 |
| 9,187,978 | B2 * | 11/2015 | Castro | E21B 23/0413 |
| 9,574,414 | B2 * | 2/2017 | Arabsky | E21B 34/142 |
| 10,018,015 | B2 * | 7/2018 | Purkis | E21B 23/06 |
| 10,597,974 | B2 * | 3/2020 | Atkins | E21B 21/103 |
| 11,466,528 | B2 * | 10/2022 | Cho | E21B 43/26 |
| 2010/0032155 | A1 * | 2/2010 | Darnell | E21B 23/04 166/373 |
| 2010/0132954 | A1 * | 6/2010 | Telfer | E21B 34/142 166/373 |
| 2010/0252276 | A1 * | 10/2010 | Clausen | E21B 23/006 166/381 |
| 2011/0073321 | A1 * | 3/2011 | Fay | E21B 23/04 166/194 |
| 2011/0240315 | A1 * | 10/2011 | McNeilly | E21B 34/14 166/386 |
| 2011/0315389 | A1 * | 12/2011 | Crider | E21B 21/103 166/329 |
| 2011/0315390 | A1 * | 12/2011 | Guillory | E21B 23/006 166/329 |
| 2013/0025876 | A1 * | 1/2013 | McCoy | E21B 34/063 166/373 |
| 2013/0299184 | A1 * | 11/2013 | Ali | E21B 34/142 166/332.3 |
| 2014/0138101 | A1 * | 5/2014 | Arabsky | E21B 33/12 166/387 |
| 2014/0251629 | A1 * | 9/2014 | Castro | E21B 34/14 166/318 |
| 2015/0159469 | A1 * | 6/2015 | Purkis | E21B 47/06 166/185 |
| 2016/0040508 | A1 * | 2/2016 | Webster | E21B 21/103 166/244.1 |
| 2016/0130910 | A1 * | 5/2016 | Gonzalez | E21B 23/006 166/250.01 |
| 2016/0245043 | A1 * | 8/2016 | Naedler | E21B 43/261 |
| 2019/0003283 | A1 * | 1/2019 | Atkins | E21B 34/10 |
| 2020/0149363 | A1 * | 5/2020 | Cho | E21B 41/0035 |
| 2022/0098945 | A1 * | 3/2022 | Wardley | E21B 23/0413 |
| 2024/0247566 | A1 * | 7/2024 | Telfer | E21B 33/12 |

FOREIGN PATENT DOCUMENTS

| | | | | |
|---|---|---|---|---|
| GB | 2626931 | A * | 8/2024 | E21B 21/103 |
| NO | 20211542 | A1 * | 4/2023 | E21B 43/12 |
| WO | 2008036575 | A1 | 3/2008 | |
| WO | WO-2023200751 | A1 * | 10/2023 | |

* cited by examiner

ON DEMAND LOW SHOCK BALL SEAT SYSTEM AND METHOD

CROSS-REFERENCE PARAGRAPH

This application is a national stage entry under 35 U.S.C. 371 of International Application No. PCT/US2022/029598, entitled "On Demand Low Shock Ball Seat System and Method," filed May 17, 2022, which claims the benefit of U.S. Provisional Application No. 63/196,246, entitled "On Demand Low Shock Ball Seat System and Method," filed Jun. 3, 2021, the disclosure of which is incorporated herein by reference in its entirety.

BACKGROUND

In a variety of well applications, techniques are employed to temporarily plug a well string, e.g. a drill string, work string, casing string. The temporary plugging enables application of pressure in the well string to carry out hydraulic tasks and events before reopening the internal passage of the well string. Existing techniques may utilize dropping of a ball downhole for receipt on a ball seat so as to block/plug the internal passage of the well string, thus enabling pressuring up of the well string. However, existing techniques and systems may be subject to functioning late or prematurely which can cause undesirable actuation or lack of actuation with respect to hydraulic tools located within the well. Additionally, releasing the plug/ball can lead to pressure surges of fluid downhole which can cause a pack off event in the wellbore or other damage to the wellbore.

SUMMARY

In general, a system and methodology facilitate temporary plugging of a well string via a ball seat assembly which may be actuated on demand. The ball seat assembly is provided with a ball seat mechanism able to temporarily block passage of a ball and thus provide temporary plugging along a well string. The ball seat mechanism works in cooperation with an on-demand assembly which may be actuated via a pattern of pressure changes applied within the ball seat assembly. The on-demand assembly is constructed such that the pattern of pressure changes enables shifting of the ball seat mechanism to a ball release position. However, the ball seat mechanism is not able to function until the desired pattern of pressure changes is completed. Additionally, the on-demand assembly may be structured such that the ball seat mechanism is transitioned to the ball release position at a low pressure point to avoid pressure surges within the well string.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology which facilitate temporary plugging of a well string via a ball seat assembly which may be actuated on demand. The ball seat assembly is constructed to ensure on-demand actuation so as to avoid undesirable late or premature actuation of the ball seat assembly. Additionally, the ball seat assembly is constructed as a low shock system to enable unplugging of the well string, e.g. release of a ball, when the interior of the ball seat assembly is at a low pressure. The release at low pressure reduces or eliminates pressure surges which can potentially cause damage in the wellbore.

According to an embodiment, the ball seat assembly is provided with a ball seat mechanism able to temporarily block passage of a ball and thus provide temporary plugging along a well string. It should be noted the ball may comprise a variety of devices designed to temporarily plug the well string. For example, the ball may comprise a spherical ball, a non-spherical ball, a dart, or other suitable devices able to form the desired seal along the interior of the ball seat assembly so as to temporarily plug the well string.

The ball seat mechanism works in cooperation with an on-demand assembly which may be actuated via a pattern of pressure changes applied within the ball seat assembly. The on-demand assembly is constructed such that the pattern of pressure changes is able to shift the ball seat mechanism to a ball release position. However, the ball seat mechanism is not able to function until the desired pattern of pressure changes is completed. Additionally, the on-demand assembly may be structured such that the ball seat mechanism is transitioned to the ball release position at a low pressure point to avoid pressure surges within the well string. For example, the pattern of pressure changes may conclude at a low pressure at which point a spring actuates to cause release of the ball and to thus open the passage through the ball seat assembly with minimal or no pressure surge.

Figure 1:
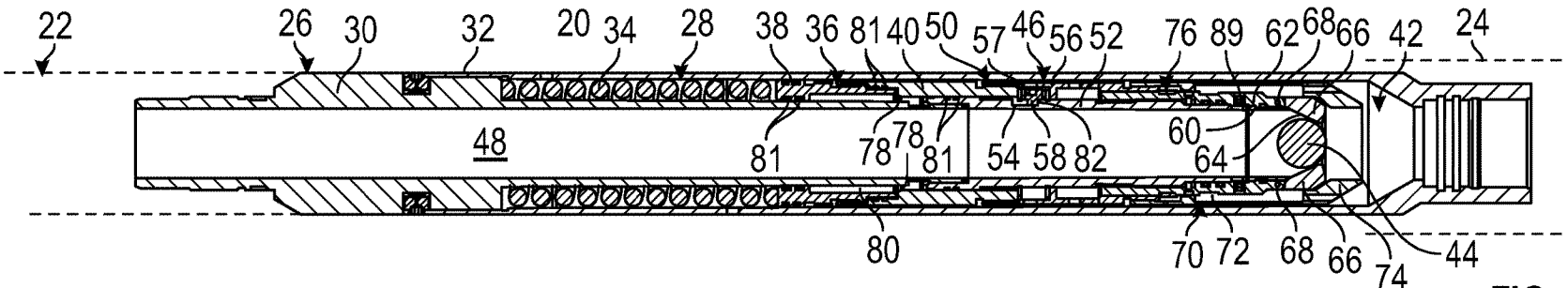
FIG. 1 is a cross-sectional illustration of an example of a ball seat assembly coupled into a well string, according to an embodiment of the disclosure.

Referring generally to FIG. 1, an example of a ball seat assembly 20 is illustrated as deployed along a well string 22 which may be conveyed downhole into a wellbore 24. In this example, the ball seat assembly 20 comprises a housing 26 and a spring 28 captured in the housing 26. By way of example, the housing 26 may comprise a plurality of sub housings 30, 32 which are threadably coupled together or otherwise suitably connected. In the illustrated example, spring 28 is in the form of a coil spring 34 captured radially between portions of the sub housings 30, 32. It should be noted, however, other types of springs 28 may be utilized to provide a desired actuation force as described in greater detail below.

In this example, the ball seat assembly 20 further comprises a piston 36 which acts against the spring 28. The piston 36 may be constructed as a unitary piston or from a plurality of piston components, such as a primary piston 38 threadably engaged or otherwise suitably engaged with a piston extension 40. In the illustrated embodiment, the primary piston 38 is positioned to abut spring 28 and is located between the same portions of sub housings 30, 32 as the spring 28.

As further illustrated in FIG. 1, the ball seat assembly 20 also comprises a ball seat mechanism 42 releasably secured in a position to trap a ball 44 so as to cause a temporary plugging of the well string 22, e.g. work string. Additionally, the ball seat assembly 20 comprises an indexing assembly 46 operatively coupled between the piston 36 and the ball seat mechanism 42. The indexing assembly 46 is constructed to be indexed to different positions in response to suitable changes in pressure within the ball seat assembly 20. For example, the pressure along an interior 48 of the ball seat assembly 20 may be sufficiently increased and decreased to cause corresponding movement of the piston 36 and connected indexing assembly 46. After a predetermined number of sufficient pressure changes occurs, the pressure is decreased to allow the spring 28 to actuate the ball seat mechanism 42, thus enabling release of ball 44 while interior 48 is at a low pressure. As explained in greater detail below, the spring 28, piston 36, and indexing assembly 46 function together as an on-demand assembly 50 which cooperates to enable on-demand release of ball 44 without risking late or premature release.

Figure 4:
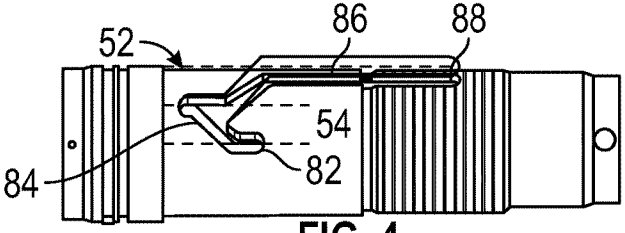
FIG. 4 is a side view of an example of a portion of an indexing assembly comprising a slot configured to provide a desired indexing functionality, according to an embodiment of the disclosure.

According to an embodiment, the indexing assembly 46 may comprise a slot sub 52 defining a slot or track 54 (see also FIG. 4). In some embodiments, the slot sub 52 may be in the form of a J-slot sub in which the slot 54 is formed as a J-slot to form an overall J-slot indexing assembly 46. However, slot 54 may be formed with a variety of patterns selected to enable, for example, a desired number of high pressure and low pressure cycles prior to release of the ball 44. The slot sub 52 may be threadably secured or otherwise suitably secured to housing 26, e.g. to sub housing 30.

In the example illustrated, the indexing assembly 46 further comprises an index ring housing 56 positioned about the slot sub 52. The index ring housing 56 receives an index ring 57 to which an index pin 58 is secured, e.g. threadably secured. Additionally, the index pin 58 is slidably received in slot 54 so as to track along slot 54 as the indexing assembly 46 is cycled. In some embodiments, the index ring 57 may be trapped between the index ring housing 56 and piston 36. Additionally, the index ring housing 56 is secured to piston 36, e.g. to piston extension 40, so as to enable linear movement of the index ring housing 56, index ring 57, and index pin 58 as the piston 36 is cycled back and forth due to the appropriate pressure increases and decreases along the interior of ball seat assembly 20. In the illustrated embodiment, rotational movement of index ring 57 relative to piston 36 and index ring housing 56 is permitted. The relative rotation between index ring 57 and piston 36/index ring housing 56 occurs as index pin 58 traverses along slot 54. In other embodiments, additional or other components may undergo this relative rotation to accommodate the lateral movement of index pin 58 as it traverses along slot 54 during cycling of the indexing assembly 46.

With additional reference to FIG. 1, the ball seat mechanism 42 may comprise various components which work in cooperation with the overall on-demand assembly 50. In the illustrated example, the ball seat mechanism 42 comprises a ball seat sleeve 60 mounted to a ball seat housing 62. The ball seat sleeve 60 may comprise a ball seat 64, e.g. a conical ball seat, against which ball 44 lands to create a temporary plug along the interior of ball seat assembly 20 and well string 22. By way of example, the ball seat 64 may be formed from a thin metal material or other suitable material for receiving the ball 44.

In this embodiment, the ball seat mechanism 42 further comprises movable dogs 66 which are positioned to support the ball seat 64 while ball 44 is used to provide the desired plugging. By way of example, the movable dogs 66 may be pivotably mounted to ball seat housing 62 via pivot pins 68 or other suitable pivot mechanisms. The movable dogs 66 are supported and prevented from releasing ball 44 by a dog retention mechanism 70. In some embodiments, the dog retention mechanism 70 may be in the form of a sleeve 72 positioned about the exterior of ball seat housing 62.

The dog retention mechanism 70 also may comprise a dog retainer 74 positioned to abut against movable dogs 66 so as to prevent movement of the dogs 66 and release of the ball 44 until a suitable pressure cycle is provided along the interior of ball seat assembly 20. In the example illustrated, the dog retention mechanism 70 is releasably secured along the ball seat housing 62 by a releasable coupling mechanism 76. The releasable coupling mechanism 76 may be in the form of a snap ring, body lock ring, shear out feature (e.g. shear screws), or other type of releasable coupling mechanism. The dog retention mechanism 70 is positioned for cooperation with the index ring housing 56 during release of ball 44.

Figure 2:
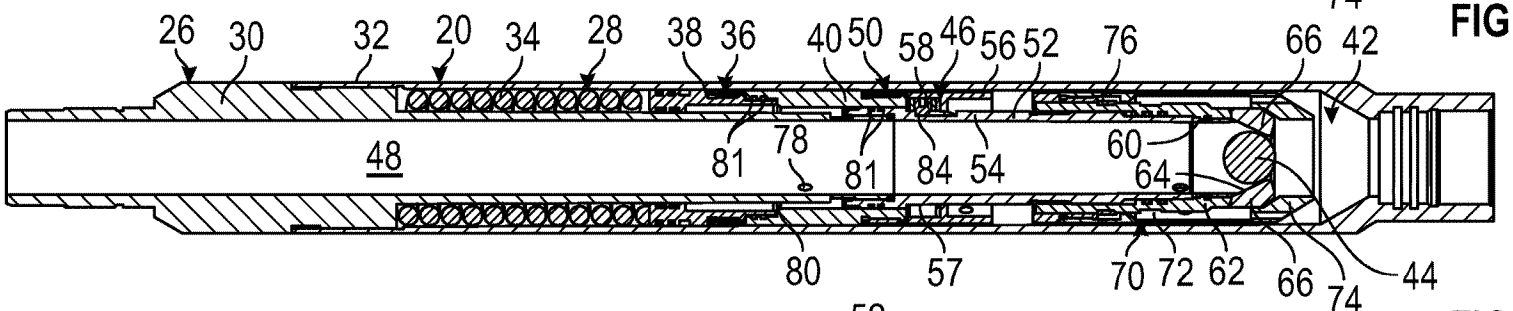
FIG. 2 is a cross-sectional illustration of the ball seat assembly illustrated in FIG. 1 but showing the ball seat assembly in a different operational position, according to an embodiment of the disclosure.
Figure 3:
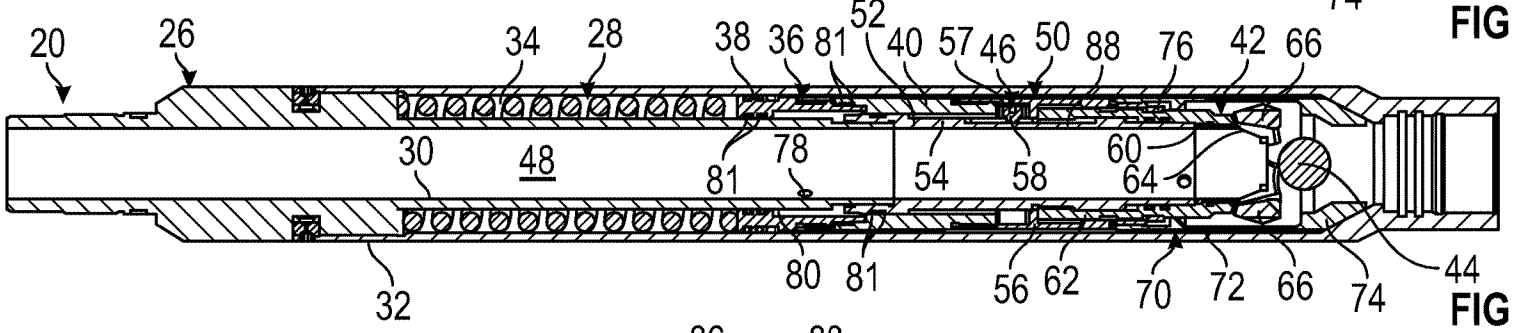
FIG. 3 is a cross-sectional illustration of the ball seat assembly illustrated in FIG. 2 but showing the ball seat assembly in a different operational position, according to an embodiment of the disclosure.

It should be noted the cycling of piston 36 and indexing assembly 46 may be achieved by providing appropriate pressure changes along interior 48 within ball seat assembly 20. As pressure is increased on fluid within interior 48, this increased pressure travels through a port or ports 78 formed laterally through sub housing 30 and into a piston chamber 80. Once the pressure in piston chamber 80 is increased sufficiently, the piston 36 is moved linearly against spring 28 to compress the spring 28 and to store additional energy in spring 28 as illustrated in FIG. 2. As the pressure in interior 48 is decreased, a corresponding decrease occurs in piston chamber 80 via ports 78. Once the pressure is sufficiently decreased, the energy stored in spring 28 forces the piston 36 and index ring housing 56 to move linearly in an opposite direction, as illustrated in FIG. 3. The pressure may be contained in piston chamber 80 by suitable seals 81. A variety of seals may be utilized between components as illustrated.

The number of pressure increases and pressure decreases before release of ball 44 may be controlled via the configuration of slot 54. If slot 54 is constructed in a simple J-slot configuration, as illustrated in FIG. 4, then a single application of high pressure moves index pin 58 from an initial slot position 82 to a single high-pressure slot position 84. Upon release of the high pressure and establishment of a sufficiently low pressure, the spring 28 is able to force index pin 58 in an opposite direction along a relatively long slot portion 86 to a slot release position 88. During these transitions, some relative lateral movement (rotation) of the index ring 57 and index pin 58 occurs relative to slot sub 52 and housing 26. Accordingly, the cross-sectional views of FIGS. 1, 2 and 3 are taken at slightly different rotational angles through housing 26 so as to show the index pin 58.

As the index pin 58 is forced along the long slot portion 86, the index ring housing 56 is forced linearly against dog retention mechanism 70 with sufficient force to release coupling mechanism 76. As a result, the dog retention mechanism 70 is moved linearly until dog retainer 74 is fully released from movable dogs 66 (see FIG. 3). This allows the movable dogs 66 to pivot radially outwardly and away from supporting ball seat 64. As a result, the ball 44 may be readily moved through ball seat 64 so as to unplug the ball seat assembly 20 and well string 22, as illustrated in FIG. 3.

It should be noted the slot 54 may be formed with additional high pressure and low pressure positions before transitioning the index pin 58 to the long slot portion 86 and release position 88. In some operations, for example, it may be useful to enable pressuring up the well string 22 a plurality of times before ultimately releasing ball 44. Additionally, some embodiments may utilize a rupture member 89 positioned in, for example, a wall of the ball seat housing 62. The rupture member 89 may be ruptured under high pressure to facilitate release of the ball 44 in the event the ball seat assembly 20 fails to function due to downhole pressure losses or other problems affecting operation. The rupture member 89 provides backup functionality in the event the normal pressure change cycles fail to release ball 44.

Figure 7:
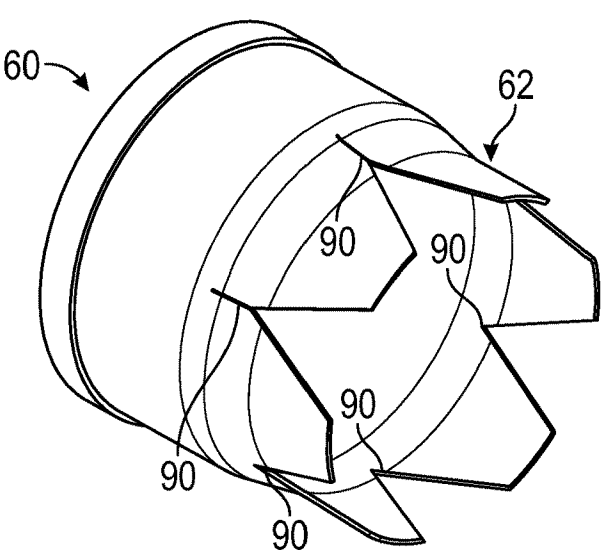
FIG. 7 is an illustration similar to that of FIG. 6 but showing the conical ball seat after a controlled tearing resulting from a well component passing therethrough, according to an embodiment of the disclosure.
Figure 6:
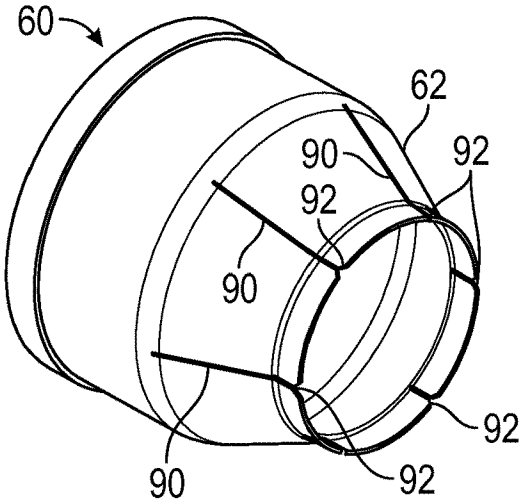
FIG. 6 is an illustration similar to that of FIG. 5 but showing the conical ball seat following passage of a ball therethrough, according to an embodiment of the disclosure.
Figure 5:
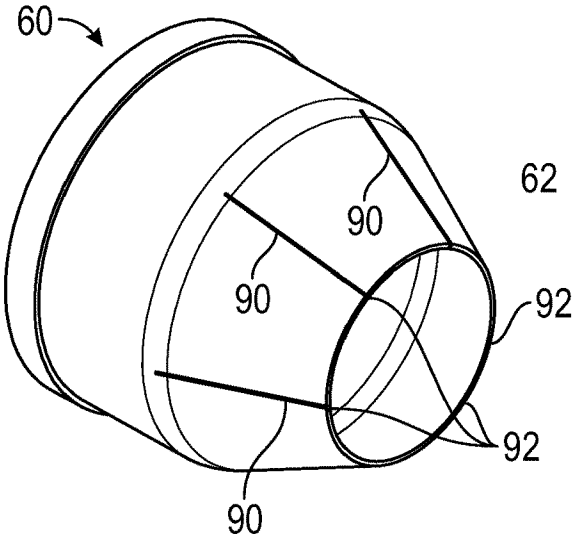
FIG. 5 is an orthogonal view of an example of a ball seat sleeve having a thin conical ball seat, according to an embodiment of the disclosure.

Referring generally to FIGS. 5-7, an example of ball seat sleeve 60 is illustrated as having a conically shaped ball seat 64. As illustrated, the conical ball seat 64 comprises longitudinal scribe lines 90 terminating in notches 92 (see FIG. 5). By way of example, the conical ball seat 64 may be formed of a metal material and the scribe lines 90 may be etched, cut or otherwise formed in the metal material. The notches 92 work in cooperation with the scribe lines 90 to help initiate and control tearing and separation of the conical ball seat 64 as ball 44 is moved through the conical ball seat 64 after release of the movable dogs 66. The tearing along scribe lines 90 and the separation of ball seat 64 after passage of ball 44 is illustrated in FIG. 6. If a tool or other device with a larger diameter than ball 44 is subsequently moved through the ball seat 64, the scribe lines 90 help ensure continued controlled tearing along the scribe lines 90 while additional separation occurs, as illustrated in FIG. 7.

In an operational example, the ball seat assembly 20 is initially run in hole into wellbore 24 on well string 22 and then pressure balanced. The piston 36 may initially be positioned to preload spring 28. The piston 36 may be held in this initial preload position via index pin 58 captured at the initial slot position 82. In other words, the configuration of slot 54 may be selected and located to establish this initial preload.

Subsequently, ball 44 is dropped down through the well string 22 and landed on ball seat 64. To actuate the ball seat assembly 20, pressure is applied down through the well string 22 and this pressure acts on piston 36 via ports 78 and piston chamber 80. The increased pressure forces the piston 36 in an uphole direction and further compresses the spring 28, thus further loading the spring 28. During this linear shifting in the uphole direction, the index ring housing 56 also rotates as the index pin 58 moves along slot 54 from the initial slot position 82 to the next slot position 84. At slot position 84, the index ring housing 56 effectively bottoms out on the slot sub 52 and stops further lineal movement and prevents further compression of spring 28.

As pressure is bled off, the spring 28 decompresses and mechanically forces piston 36 in a generally lineal, opposite, downhole direction. During this downhole directed movement, the index pin 58 tracks along slot 54 and moves along the long slot portion 86 until stopping at slot position 88 which is located farther in the downhole direction than the initial slot position 82. As a result, the spring 28 is able to decompress to a greater degree than the initial run-in position at slot position 82. During this transition, the index ring housing 56 engages dog retention mechanism 70 and forces the dog retention mechanism 70 in a downhole direction. This movement of dog retention mechanism 70 moves the dog retainer 74 away from the dogs 66. The dog retention mechanism 70 has a sufficiently large inside diameter so that the movable dogs 66 can now be forced in a radially outward direction as the ball 44 passes through the ball seat 64 under minimal pressure.

If the ball seat assembly 20 fails to function due to, for example, fluid/pressure losses below the ball seat assembly, the rupture member 89 (or other pressure transfer feature) may be ruptured. The rupture may be caused by applying pressure down through the well string 22 until a pressure above the pressure rating of the rupture member 89 is achieved. Once ruptured, pressure within the ball seat assembly 20 can equalize on both sides of the piston 36 which allows the spring 28 to fully decompress as described above.

Figure 8:
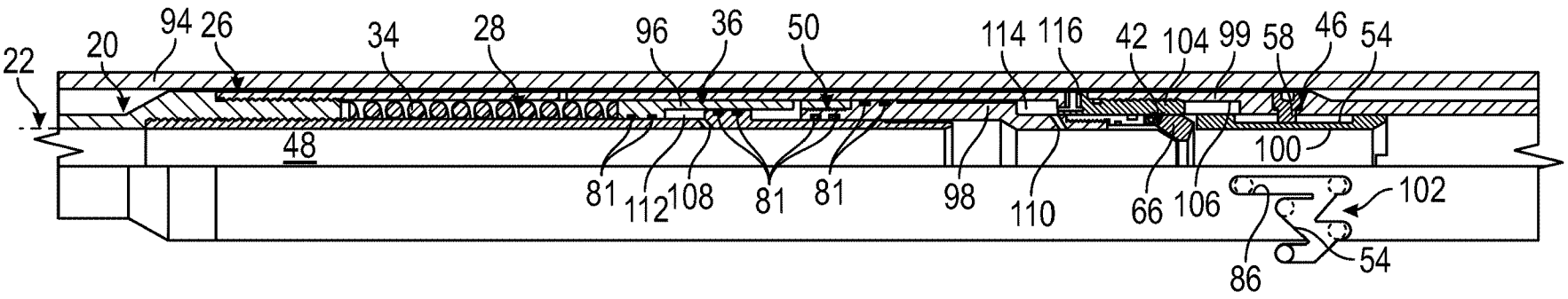
FIG. 8 is a partial cross-sectional illustration of another example of a ball seat assembly, according to an embodiment of the disclosure.

Referring generally to FIG. 8, another embodiment of the ball seat assembly 20 is illustrated. In this example, the ball seat assembly 20 is part of well string 22 and is illustrated as deployed within a surrounding body 94, e.g. a liner hanger body. The ball seat assembly 20 again comprises housing 26 and spring 28 captured in the housing 26. By way of example, the housing 26 may comprise a plurality of housing sections which are threadably coupled together or otherwise suitably connected. Spring 28 may be in the form of coil spring 34 or other suitable spring captured radially between portions of the housing 26.

In this embodiment, the ball seat assembly 20 also comprises piston 36 which acts against the spring 28. The piston 36 may be constructed from a plurality of piston components, such as a piston extensions sleeve 96 threadably engaged or otherwise suitably engaged with a large piston sub 98. This embodiment of the ball seat assembly 20 also comprises ball seat mechanism 42 releasably secured in a position to trap ball 44 so as to cause a temporary plugging of the well string 22. Additionally, the ball seat assembly 20 comprises indexing assembly 46 operatively coupled with the ball seat mechanism 42.

In this example, however, the indexing assembly 46 comprises a ball seat dog recess sleeve 99 threadably or otherwise connected with housing 26. The index pin 58 is securely mounted to the ball seat dog recess sleeve 99 and received in slot 54 of an internal slot sub 100 threadably or otherwise secured to the large piston sub 98. The slot 54 may again be formed in a variety of configurations such as the illustrated slot example 102 (see inset in FIG. 8) constructed to cycle through two high pressure inputs and an additional low pressure input before enabling release of the movable dogs 66. In this example, the movable dogs 66 are pivotably mounted to the internal slot sub 100 and held against the ball seat 64 by an abutment portion 104 of housing 26. When the index pin 58 is ultimately transitioned along long slot portion 86, the movable dogs 66 are shifted to a recess 106 formed by the ball seat dog recess sleeve 99. The recess 106 allows the movable dogs 66 to be pivoted in a radially outward direction as the ball 44 is passed through ball seat 64.

In an operational example utilizing the embodiment of FIG. 8, the ball seat assembly 20 is initially run in hole into wellbore 24 on well string 22 and then pressure balanced. The piston 36 may initially be positioned to preload spring 28. The piston 36 may be held in this initial preload position via index pin 58 captured at an initial slot position as described above.

Subsequently, ball 44 is drop down through the well string 22 and landed on ball seat 64. To actuate the ball seat assembly 20, pressure is applied down through the well string 22 and this pressure acts on piston 36 via ports 108, 110 which lead to corresponding piston chambers 112, 114. The increased pressure forces the piston 36 in an uphole direction and further compresses the spring 28. During this linear shifting in the uphole direction, the piston 36 and internal slot sub 100 also rotate as the index pin 58 moves along slot 54 from an initial slot position to the next sequential slot position. As pressure is bled off, the spring 28 decompresses and mechanically forces piston 36 in a generally lineal, opposite, downhole direction. During this downhole directed movement, the index pin 58 tracks along slot 54 to the next sequential slot position. In this specific example, the increased pressure cycle and decreased pressure cycle are repeated to transition the index pin 28 into the long slot portion 86.

At this stage, the spring 28 is able to force linear movement of the piston 36 and internal slot sub 100 until index pin 58 is located in the final slot position. As a result, the spring 28 is able to decompress to a greater degree than the initial run-in position and this shifts the movable dogs (attached to internal slot sub 100) to the recess 106. The recess 106 allows the movable dogs 66 to be forced in a radially outward direction as the ball 44 passes through the ball seat 64 under minimal pressure.

If the ball seat assembly 20 fails to function due to, for example, fluid/pressure losses below the ball seat assembly, a rupture member 116 (or other pressure transfer feature) disposed through housing 26 may be ruptured. The rupture may be caused by applying pressure down through the well string 22 until a pressure above the pressure rating of the rupture member 116 is achieved. Once ruptured, pressure equalizes and allows the spring 28 to fully decompress and transition movable dogs 66 into proximity with recess 106.

Depending on the parameters of a given well environment, wellbore, and operational considerations, the ball seat assembly 20 may comprise a variety of components and arrangements of components. For example, various types of pistons, indexing assemblies, and ball retention mechanisms may be utilized. The movable dogs 66 may be pivotably attached or otherwise attached so as to enable movement in a generally radially outward direction when released. The indexing assembly may comprise a variety of slot configurations with different numbers of pressure cycles until the ultimate release cycle. Additionally, the spring 28 and other components of the ball seat assembly 20 may be selected to achieve the desired pressures or pressure ranges at which the uphole and downhole shifting occurs. The spring 28 may be mounted between, within, or at various positions with respect to portions of housing 26.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a ball seat assembly positioned along a well string to enable temporary plugging of the well string while actuation pressure is built up within the well string, the ball seat assembly comprising:

a housing comprising a plurality of sub housings coupled to each other;

a coil spring captured radially between sub housings of the plurality of sub housings;

a piston positioned to act against the coil spring to increase loading on the coil spring as a pressure is applied within the ball seat assembly after plugging of the ball seat assembly;

a ball seat mechanism releasably secured in a position to trap a ball so as to cause plugging of the ball seat assembly and thus plugging of the well string; and an indexing assembly operatively coupled to the piston and the ball seat mechanism, the indexing assembly indexing to different positions in response to suitable changes in pressure within the ball seat assembly, the indexing assembly preventing release of the ball until a predetermined number of pressure changes occurs and the pressure is sufficiently decreased to enable the coil spring to actuate release of the ball at a low internal pressure within the ball seat assembly.

2. The system as recited in claim 1, wherein the piston comprises a plurality of piston components coupled together.

3. The system as recited in claim 1, wherein the ball seat mechanism comprises a ball seat sleeve having a conical ball seat against which the ball is received, the conical ball seat being supported by movable dogs temporarily secured by a dog retainer.

4. The system as recited in claim 3, wherein the dog retainer is positioned to be acted on via movement of the piston so as to release the movable dogs, thus enabling release of the ball.

5. The system as recited in claim 3, wherein the movable dogs are pivotably mounted to a ball seat housing of the ball seat mechanism.

6. The system as recited in claim 3, wherein the conical ball seat comprises longitudinal scribe lines terminating in notches to control tearing of the conical ball seat as the ball is moved through the conical ball seat after release of the movable dogs.

7. The system as recited in claim 6 wherein the scribe lines have sufficient length to further enable controlled tearing of the conical ball seat along the scribe lines as a component with a larger diameter than the ball is moved through the ball seat assembly.

8. The system as recited in claim 1, wherein the indexing assembly comprises an index ring housing and an index ring combined with an index pin, the index ring undergoing linear and rotational movement as the index pin is moved along a corresponding slot while the piston is cycled linearly back and forth.

9. The system as recited in claim 1, wherein the ball seat assembly comprises a rupture member located to release internal pressure within the ball seat assembly when ruptured, thus providing backup functionality in the event the suitable changes in pressure fail to release the ball.

10. A system, comprising:

a ball seat assembly for use in a well, the ball seat assembly comprising:

a housing including a plurality of sub housings coupled to each other;

a coil spring captured radially between the sub housings of the plurality of sub housings; and a ball seat mechanism able to temporarily trap a ball so as to plug the ball seat assembly, the ball seat assembly further comprising an on-demand assembly including:

a piston; and the coil spring, wherein the coil spring is actuatable via a pattern of pressure changes applied within the ball seat assembly to thus shift the ball seat mechanism to a ball release position, the pattern of pressure changes comprising relatively high and low pressures, release of the ball being prevented until a final low pressure is applied, and wherein the piston acts against the coil spring as the pattern of pressure changes occur to actuate the coil spring.

11. The system as recited in claim 10, wherein the on-demand assembly further comprises an indexing assembly operatively coupled with the ball seat mechanism, the indexing assembly preventing release of the ball until the pattern of pressure changes is completed.

12. The system as recited in claim 11, wherein the indexing assembly comprises an index ring housing combined with an index ring connected to an index pin, the index ring rotating as the index pin is moved along a corresponding slot as the piston is cycled linearly back and forth.

13. The system as recited in claim 12, wherein the ball seat mechanism comprises a ball seat sleeve having a conical ball seat against which the ball is received, the conical ball seat being supported by movable dogs temporarily secured by a dog retainer.

14. The system as recited in claim 13, wherein the dog retainer is positioned to be acted on by the index ring housing which, in turn, is shifted via movement of the piston so as to release the movable dogs, thus enabling release of the ball.

15. The system as recited in claim 14, wherein the conical ball seat comprises longitudinal scribe lines terminating in notches to control tearing of the conical ball seat as the ball is moved through the conical ball seat after release of the movable dogs.

16. A method, comprising:

providing a ball seat mechanism in a ball seat assembly to temporarily block passage of a ball via a ball seat and a plurality of movable dogs supporting the ball seat, the ball seat mechanism disposed in a housing of the ball seat assembly, the housing including a plurality of sub housings coupled to each other;

securing the ball seat against movement of the ball therethrough via a dog retainer mechanism engaging the plurality of movable dogs;

positioning a coil spring radially captured between the sub housings of the plurality of sub housings to provide spring actuation of the dog retainer mechanism to enable on-demand release of the plurality of movable dogs and thus release of the ball; and preventing spring actuation of the dog retainer mechanism utilizing a piston acted on by the spring and a J-slot mechanism positioned between the piston and the dog retainer mechanism until a series of high and low pressure changes is applied within the ball seat assembly and completed at a low pressure level.

17. The method as recited in claim 16, further comprising coupling the ball seat assembly into a well string.

* * * * *